US007967081B2

(12) United States Patent
Sugiura et al.

(10) Patent No.: US 7,967,081 B2
(45) Date of Patent: Jun. 28, 2011

(54) CLOSED-LOOP PHYSICAL CALIPER MEASUREMENTS AND DIRECTIONAL DRILLING METHOD

(75) Inventors: Junichi Sugiura, Houston, TX (US); Stephen Jones, Cypress, TX (US)

(73) Assignee: Smith International, Inc., Houston, TX (US)

( * ) Notice: Subject to any disclaimer, the term of this patent is extended or adjusted under 35 U.S.C. 154(b) by 376 days.

(21) Appl. No.: 12/332,911

(22) Filed: Dec. 11, 2008

(65) Prior Publication Data

US 2009/0090554 A1 Apr. 9, 2009

Related U.S. Application Data

(63) Continuation-in-part of application No. 11/595,054, filed on Nov. 9, 2006, now Pat. No. 7,464,770.

(51) Int. Cl.
*E21B 44/00* (2006.01)
*E21B 47/08* (2006.01)
*E21B 47/06* (2006.01)

(52) U.S. Cl. ..... 175/25; 175/24; 175/40; 175/61

(58) Field of Classification Search ..... 175/24, 175/25, 40, 61

See application file for complete search history.

(56) References Cited

U.S. PATENT DOCUMENTS

| | | | |
|---|---|---|---|
| 2,373,880 | A | 4/1945 | Driscoll |
| 2,603,163 | A | 7/1952 | Nixon |
| 2,874,783 | A | 2/1959 | Haines |
| 2,880,805 | A | 4/1959 | Nelson et al. |
| 2,915,011 | A | 12/1959 | Hamill |
| 4,251,921 | A | 2/1981 | Fink |
| 4,407,374 | A | 10/1983 | Wallussek et al. |
| 4,416,339 | A | 11/1983 | Baker et al. |
| 4,463,814 | A | 8/1984 | Horstmeyer et al. |
| 4,715,440 | A | 12/1987 | Boxell |
| 4,844,178 | A | 7/1989 | Cendre et al. |
| 4,947,944 | A | 8/1990 | Coltman et al. |
| 4,957,173 | A | 9/1990 | Kinnan |

(Continued)

FOREIGN PATENT DOCUMENTS

EP 1174582 A3 1/2002

(Continued)

OTHER PUBLICATIONS

International Search Report and Written Opinion dated Jul. 19, 2010 for corresponding International Application No. PCT/US2009/067651 filed Dec. 11, 2009.

*Primary Examiner* — Daniel P Stephenson
*Assistant Examiner* — Brad Harcourt

(57) ABSTRACT

Aspects of this invention include a downhole tool and method for making a physical caliper measurement of a subterranean borehole. The tool is configured to make the physical borehole caliper measurement only when the measured pressure in each of three or more outwardly extendable blades is greater than a predetermined threshold pressure. Blade positions are measured and the borehole caliper calculated only when the pressure in each of the blades exceeds the threshold. Exemplary embodiments of the invention enable physical caliper measurements to be made with increased accuracy with each of the blades making firm contact with the borehole wall. Methods in accordance with the invention are especially well suited for use in directional drilling applications in that they tend to enable accurate caliper measurements to be made without repositioning the steering tool in the borehole.

17 Claims, 5 Drawing Sheets

U.S. PATENT DOCUMENTS

| | | | |
|---|---|---|---|
| 4,982,383 | A | 1/1991 | Sims et al. |
| 5,070,950 | A | 12/1991 | Cendre et al. |
| 5,168,941 | A | 12/1992 | Krueger et al. |
| 5,341,886 | A | 8/1994 | Patton |
| 5,355,950 | A | 10/1994 | Zwart |
| 5,603,386 | A | 2/1997 | Webster |
| 5,629,480 | A | 5/1997 | Herget |
| 5,797,453 | A | 8/1998 | Hisaw |
| 5,941,323 | A | 8/1999 | Warren |
| 6,148,933 | A | 11/2000 | Hay et al. |
| 6,158,529 | A | 12/2000 | Dorel |
| 6,233,564 | B1 | 5/2001 | Harrell et al. |
| 6,257,356 | B1 | 7/2001 | Wassell |
| 6,290,003 | B1 | 9/2001 | Russell |
| 6,427,783 | B2 | 8/2002 | Krueger et al. |
| 6,513,606 | B1 | 2/2003 | Krueger |
| 6,609,579 | B2 | 8/2003 | Krueger et al. |
| 6,662,110 | B1 | 12/2003 | Bargach et al. |
| 6,702,010 | B2 | 3/2004 | Yuratich et al. |
| 6,761,232 | B2 | 7/2004 | Moody et al. |
| 6,833,706 | B2 | 12/2004 | Niina |
| 6,848,189 | B2 | 2/2005 | Moake et al. |
| 7,377,333 | B1 | 5/2008 | Sugiura |
| 2001/0042643 | A1 | 11/2001 | Krueger et al. |
| 2006/0113111 | A1* | 6/2006 | Martinez et al. ..... 175/45 |
| 2006/0185902 | A1 | 8/2006 | Song et al. |
| 2006/0249307 | A1 | 11/2006 | Ritter et al. |
| 2008/0110674 | A1 | 5/2008 | Jones |

FOREIGN PATENT DOCUMENTS

| | | | |
|---|---|---|---|
| WO | WO-98-34003 | A1 | 8/1998 |
| WO | WO-00-28188 | A1 | 5/2000 |
| WO | WO-01-51761 | A1 | 7/2001 |
| WO | WO-03-097989 | A1 | 11/2003 |

* cited by examiner 28
10
26
12
20
30
18
22
16
42
40
100
150
32

CLOSED-LOOP PHYSICAL CALIPER MEASUREMENTS AND DIRECTIONAL DRILLING METHOD

RELATED APPLICATIONS

This application is a continuation-in-part of co-pending, commonly-invented, and commonly-assigned U.S. patent application Ser. No. 11/595,054 entitled Closed-Loop Control of Hydraulic Pressure in a Downhole Steering Tool.

FIELD OF THE INVENTION

The present invention relates generally to downhole tools, for example, including directional drilling tools such as three-dimensional rotary steerable tools (3DRS). More particularly, embodiments of this invention relate to closed-loop control of physical caliper measurements and directional drilling methods in rotary steerable tools.

BACKGROUND OF THE INVENTION

Directional control has become increasingly important in the drilling of subterranean oil and gas wells, for example, to more fully exploit hydrocarbon reservoirs. Downhole steering tools, such as two-dimensional and three-dimensional rotary steerable tools, are commonly used in many drilling applications to control the direction of drilling. Such steering tools commonly include a plurality of force application members (also referred to herein as blades) that may be independently extended out from and retracted into a housing. The blades are disposed to extend outward from the housing into contact with the borehole wall. The direction of drilling may be controlled by controlling the magnitude and direction of the force or the magnitude and direction of the displacement applied to the borehole wall. In rotary steerable tools, the housing is typically deployed about a shaft, which is coupled to the drill string and disposed to transfer weight and torque from the surface (or from a mud motor) through the steering tool to the drill bit assembly.

In general, the prior art discloses two types of directional control mechanisms employed with rotary steerable tool deployments. U.S. Pat. Nos. 5,168,941 and 6,609,579 to Krueger et al disclose examples of rotary steerable tool deployments employing the first type of directional control mechanism. The direction of drilling is controlled by controlling the magnitude and direction of a side (lateral) force applied to the drill bit. This side force is created by extending one or more of a plurality of ribs (referred to herein as blades) into contact with the borehole wall and is controlled by controlling the pressure in each of the blades. The amount of force on each blade is controlled by controlling the hydraulic pressure at the blade, which is in turn controlled by proportional hydraulics or by switching to the maximum pressure with a controlled duty cycle. Krueger et al further disclose a hydraulic actuation mechanism in which each steering blade is independently controlled by a separate piston pump. A control valve is positioned between each piston pump and its corresponding blade to control the flow of hydraulic fluid from the pump to the blade. During drilling each of the piston pumps is operated continuously via rotation of a drive shaft.

U.S. Pat. No. 5,603,386 to Webster discloses an example of a rotary steerable tool employing the second type of directional control mechanism. Webster discloses a mechanism in which the steering tool is moved away from the center of the borehole via extension (and/or retraction) of the blades. The direction of drilling may be controlled by controlling the magnitude and direction of the offset between the tool axis and the borehole axis. The magnitude and direction of the offset are controlled by controlling the position of the blades.

In general, increasing the offset (i.e., increasing the distance between the tool axis and the borehole axis) tends to increase the curvature (dogleg severity) of the borehole upon subsequent drilling. Webster also discloses a hydraulic mechanism in which all three blades are controlled via a single pump and pressure reservoir and a plurality of valves. In particular, each blade is controlled by three check valves. The nine check valves are in turn controlled by eight solenoid controlled pilot valves. Commonly assigned U.S. Pat. No. 7,204,339 employs hydraulic actuation to extend the blades and a spring biased mechanism to retract the blades. Spring biased retraction of the blades advantageously reduces the number of valves required to control the blades. The '339 application is similar to the Webster patent in that only a single pump and/or pressure reservoir is required to actuate the blades.

The above described steering tool deployments are known to be commercially serviceable. Notwithstanding, there is room for improvement of such tool deployments, especially for smaller diameter steering tool embodiments. For example, there is a need for improved caliper measurements for accurately determining the position of the center of the borehole and the diameter of the borehole in steering tools employing the above-described second type of directional control mechanism.

SUMMARY OF THE INVENTION

The present invention addresses the need for an improved caliper measurement method and directional drilling methods in downhole deployments. Aspects of this invention include a downhole tool having a controller configured to make a physical borehole caliper measurement only when the measured pressure in each of three or more outwardly extendable blades is greater than a predetermined threshold pressure. The pressure is measured at each of the blades and compared with the pressure threshold. If the measured pressure in any one or more of the blades is less than the threshold pressure, then the corresponding blade is extended outward from the tool body until the measured pressure is greater than the threshold. The blade positions are measured and the borehole caliper calculated only when the pressure in each of the blades exceeds the threshold. In certain advantageous embodiments, methods in accordance with the invention are utilized in directional drilling applications, for example, via using a rotary steerable directional drilling tool.

Exemplary embodiments of the present invention may advantageously provide several technical advantages. For example, exemplary embodiments of this invention enable physical caliper measurements to be made with increased accuracy with each of the blades making firm contact with the borehole wall. Methods in accordance with the invention are especially well suited for use in directional drilling applications in that they tend to enable accurate caliper measurements to be made without repositioning the steering tool in the borehole (and thereby changing the direction of drilling).

In one aspect the present invention includes a downhole steering tool configured to operate in a borehole. The steering tool includes at least three blades deployed on a housing. The blades are disposed to extend radially outward from the housing and engage a wall of the borehole, said engagement of the blades with the borehole wall operative to eccenter the housing in the borehole. The steering tool further includes a hydraulic module including a fluid chamber disposed to provide pressurized fluid to each of the plurality of blades. The pressurized fluid is operative to extend the blades, each of which includes a pressure sensor disposed to measure a fluid pressure in the blade and a position sensor disposed to measure a radial position of the blade. A controller is configured to (i) receive pressure measurements from the pressure sensors, (ii) receive radial position measurements from each of the blades only when each of the pressure measurements received in (i) is above a predetermined threshold pressure, and (iii) compute a borehole caliper from the position measurements received in (ii).

In another aspect, the present invention includes a downhole steering tool configured to operate in a borehole. The steering tool includes at least three blades deployed on a housing. The blades are disposed to extend radially outward from the housing and engage a wall of the borehole, said engagement of the blades with the borehole wall operative to eccenter the housing in the borehole. The steering tool further includes a hydraulic module including a fluid chamber disposed to provide pressurized fluid to each of the plurality of blades, the pressurized fluid operative to extend the blades. Each of the blades includes at least a first valve in fluid communication with high pressure fluid and at least a second valve in fluid communication with low pressure fluid. Each of the blades further includes a pressure sensor disposed to measure a fluid pressure in the blade and a position sensor disposed to measure a radial position of the blade. A controller is configured to (i) lock at least one of the blades in a predetermined radially extended position by closing both the corresponding first and second valves, (ii) receive pressure measurements for each of the locked blades from the corresponding pressure sensors; (iii) radially further extend at least one of the locked blades by opening the corresponding first valve when the corresponding pressure measurement is less than a predetermined threshold, (iv) receive radial position measurements for each of the blades from the corresponding position sensors only when each of the pressure measurements received in (ii) is greater than the predetermined threshold pressure, and (v) compute a borehole caliper from the position measurements received in (iv).

In still another aspect this invention includes a method of making a physical caliper measurement in a subterranean borehole. The method includes deploying a drill string in a borehole. The drill string includes a caliper measurement tool having at least three blades deployed thereon, wherein each of the blades is disposed on a tool body and configured to extend outward from the tool body into contact with a wall of the subterranean borehole. The blades are extended outward from the tool body into contact with the wall of the subterranean borehole. A blade pressure is then measured in each of the blades. The radial position of each of the blades is measured when the measured blade pressure in each of the blades is greater than a predetermined minimum threshold. The borehole caliper is then computed from the radial position measurements of the blades.

In a further aspect the present invention includes a method of directional drilling. The method includes rotating a drill string in a borehole. The drill string includes a rotary steerable tool having at least three blades deployed on a rotary steerable tool housing. The blades are disposed to extend radially outward from the housing and engage a wall of the borehole, said engagement of the blades with the borehole wall operative to eccenter the housing in the borehole. Each of the blades includes at least a first valve in fluid communication with high pressure fluid and at least a second valve in fluid communication with low pressure fluid. Each of the blades further includes a corresponding pressure sensor disposed to measure a hydraulic fluid pressure in the blade and a position sensor disposed to measure a radial position of the blade. The method further includes extending each of the blades to a corresponding first predetermined radial position. At least one of the blades is then locked at the corresponding predetermined radial position by closing the corresponding first and second valves. A hydraulic pressure is measured in each of said locked blades. At least one of the blades is further extended to a radial position beyond the corresponding first predetermined radial position by opening the corresponding first valve(s) when the corresponding measured hydraulic pressure is less than a predetermined minimum threshold so that the hydraulic pressure in the blade is greater than the predetermined minimum threshold.

The foregoing has outlined rather broadly the features of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other methods, structures, and encoding schemes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
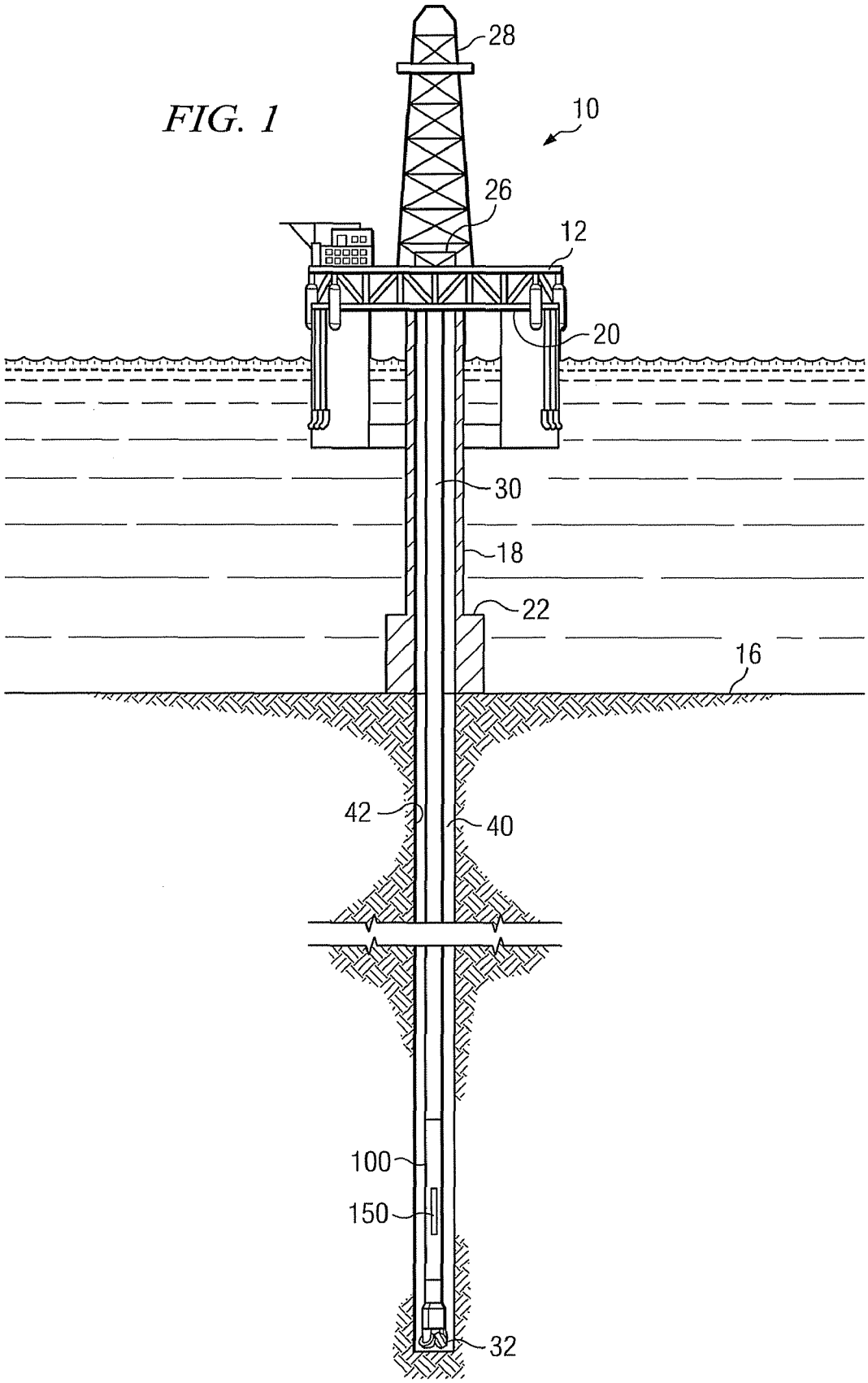
FIG. 1 depicts a drilling rig on which exemplary embodiments of the present invention may be deployed.

Referring first to FIGS. 1 through 3B, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1 through 3B may be described herein with respect to that reference numeral shown on other views.

FIG. 1 illustrates a drilling rig 10 suitable for utilizing exemplary downhole steering tool and method embodiments of the present invention. In the exemplary embodiment shown on FIG. 1, a semisubmersible drilling platform 12 is positioned over an oil or gas formation (not shown) disposed below the sea floor 16. A subsea conduit 18 extends from deck 20 of platform 12 to a wellhead installation 22. The platform may include a derrick 26 and a hoisting apparatus 28 for raising and lowering the drill string 30, which, as shown, extends into borehole 40 and includes a drill bit 32 and a steering tool 100 (such as a three-dimensional rotary steerable tool). In the exemplary embodiment shown, steering tool 100 includes a plurality of blades 150 (e.g., three) disposed to extend outward from the tool 100. The extension of the blades 150 into contact with the borehole wall is intended to eccenter the tool in the borehole, thereby changing an angle of approach of the drill bit 32 (which changes the direction of drilling). Exemplary embodiments of steering tool 100 further include hydraulic 130 and electronic 140 control modules (FIG. 2) configured to provide closed-loop control of various functions of the steering tool 100. Drill string 30 may further include a downhole drilling motor, a mud pulse telemetry system, and one or more additional sensors, such as LWD and/or MWD tools for sensing downhole characteristics of the borehole and the surrounding formation. The invention is not limited in these regards.

It will be understood by those of ordinary skill in the art that methods and apparatuses in accordance with this invention are not limited to use with a semisubmersible platform 12 as illustrated in FIG. 1. This invention is equally well suited for use with any kind of subterranean drilling operation, either offshore or onshore. While exemplary embodiments of this invention are described below with respect to rotary steerable embodiments (e.g., including a shaft disposed to rotate relative to a housing), it will be appreciated that the invention is not limited in this regard. The invention is equally well suited for use with substantially any suitable downhole steering tools that utilize a plurality of blades to eccenter the tool in the borehole. Moreover, the invention is also well suited for use with substantially any downhole tool that makes a physical caliper measurement of the borehole, including, for example, wireline tools and M/LWD tools.

Figure 2:
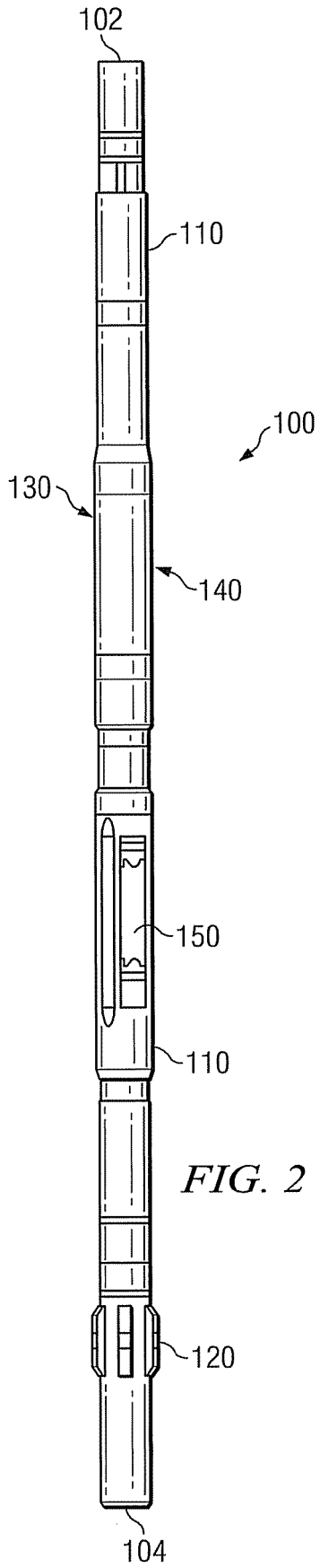
FIG. 2 is a perspective view of one exemplary embodiment of the steering tool shown on FIG. 1.

Turning now to FIG. 2, one exemplary embodiment of steering tool 100 from FIG. 1 is illustrated in perspective view. In the exemplary embodiment shown, steering tool 100 is substantially cylindrical and includes threaded ends 102 and 104 (threads not shown) for connecting with other bottom hole assembly (BHA) components (e.g., connecting with the drill bit at end 104 and upper BHA components at end 102). The steering tool 100 further includes a housing 110 and at least one blade 150 deployed, for example, in a recess (not shown) in the housing 110. Steering tool 100 further includes hydraulics 130 and electronics 140 modules (also referred to herein as control modules 130 and 140) deployed in the housing 110. In general (and as described in more detail below with respect to FIGS. 3A and 3B), the control modules 130 and 140 are configured for measuring and controlling the relative positions of the blades 150 as well as the hydraulic system and blade pressures. Control modules 130 and 140 may include substantially any devices known to those of skill in the art, such as those disclosed in U.S. Pat. No. 5,603,386 to Webster or U.S. Pat. No. 6,427,783 to Krueger et al.

Figure 3A:
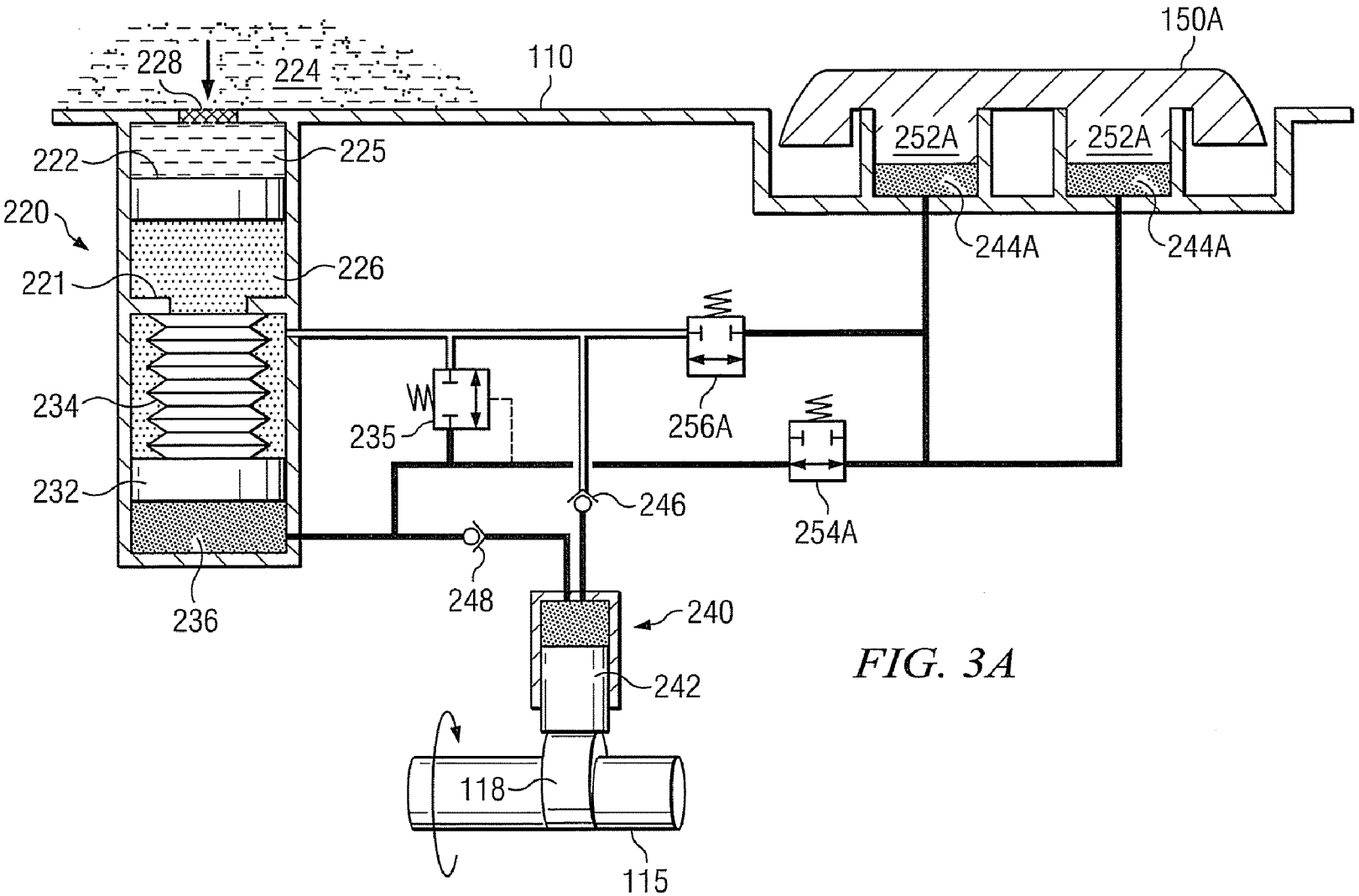
FIGS. 3A and 3B depict schematic diagrams of an exemplary hydraulic control module employed in exemplary embodiment of the steering tool shown on FIG. 2.
Figure 3B:
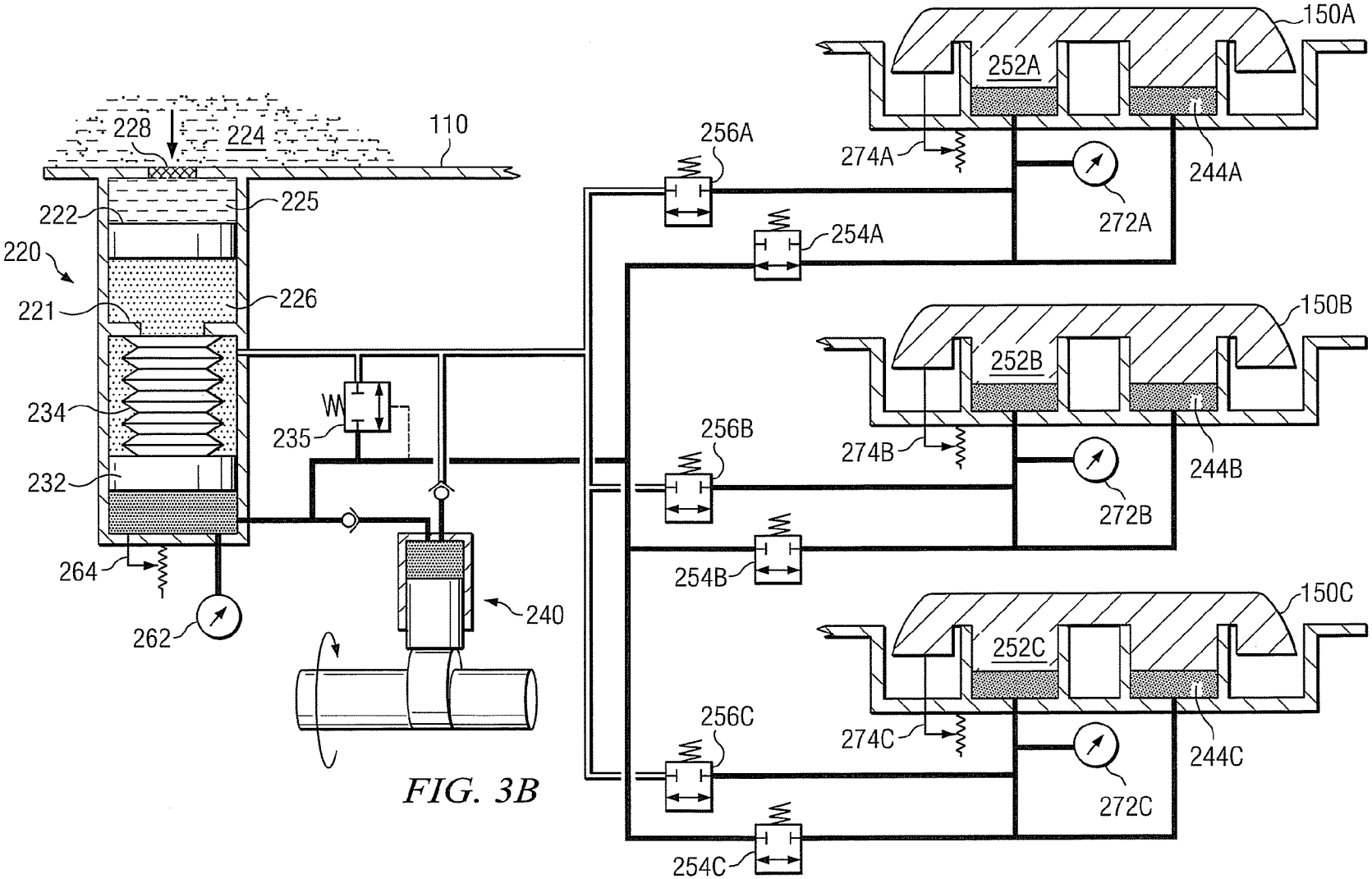

To steer (i.e., change the direction of drilling), one or more of blades 150 are extended and exert a force against the borehole wall. The steering tool 100 is moved away from the center of the borehole by this operation, altering the drilling path. It will be appreciated that the tool 100 may also be moved back towards the borehole axis if it is already eccentered. To facilitate controlled steering, the rotation rate of the housing is desirably less than 0.1 rpm during drilling, although the invention is not limited in this regard. By keeping the blades 150 in a substantially fixed position with respect to the circumference of the borehole (i.e., by preventing rotation of the housing 110), it is possible to steer the tool without constantly extending and retracting the blades 150. Non-rotary steerable embodiments are thus typically only utilized in sliding mode. In rotary steerable embodiments, the tool 100 is constructed so that the housing 110, which houses the blades 150, remains stationary, or substantially stationary, with respect to the borehole during directional drilling operations. The housing 110 is therefore constructed in a rotationally non-fixed (or floating) fashion with respect to a shaft 115 (FIGS. 3A and 3B). The shaft 115 is connected with the drill string and is disposed to transfer both torque and weight to the bit. It will be understood that the invention is not limited to rotary steerable embodiments.

In general, increasing the offset (i.e., increasing the distance between the tool axis and the borehole axis) tends to increase the curvature (dogleg severity) of the borehole upon subsequent drilling. In the exemplary embodiment shown, steering tool 100 includes near-bit stabilizer 120, and is therefore configured for "point-the-bit" steering in which the direction (tool face) of subsequent drilling tends to be in the opposite direction (or nearly the opposite; depending, for example, upon local formation characteristics) of the offset between the tool axis and the borehole axis. The invention is not limited to the mere use of a near-bit stabilizer. It is equally well suited for "push-the-bit" steering in which there is no near-bit stabilizer and the direction of subsequent drilling tends to be in the same direction as the offset between the tool axis and borehole axis.

With reference now to FIGS. 3A and 3B, one exemplary embodiment of hydraulic module 130 is schematically depicted. FIG. 3A is a simplified schematic of the hydraulic module 130 showing only a single blade 150A. FIG. 3B shows each of the three blades 150A, 150B, and 150C as well as certain of the electrical control devices (which are in electronic communication with electronic control module 140). Hydraulic module 130 includes a hydraulic fluid chamber 220 including first and second, low and high pressure reservoirs 226 and 236. In the exemplary embodiment shown, low pressure reservoir 226 is modulated to wellbore (hydrostatic) pressure via equalizer piston 222. Wellbore drilling fluid 224 enters fluid cavity 225 through filter screen 228, which is deployed in the outer surface of the non-rotating housing 110. It will be readily understood to those of ordinary skill in the art that the drilling fluid in the borehole exerts a force on equalizer piston 222 proportional to the wellbore pressure, which thereby pressurizes hydraulic fluid in low pressure reservoir 226.

Hydraulic module 130 further includes a piston pump 240 operatively coupled with drive shaft 115. In the exemplary embodiment shown, pump 240 is mechanically actuated by a cam 118 formed on an outer surface of drive shaft 115, although the invention is not limited in this regard. Pump 240 may be equivalently actuated, for example, by a swash plate mounted to the outer surface of the shaft 115 or an eccentric profile formed in the outer surface of the shaft 115. In the exemplary embodiment shown, rotation of the drive shaft 115 causes cam 118 to actuate piston 242, thereby pumping pressurized hydraulic fluid to high pressure reservoir 236. Piston pump 240 receives low pressure hydraulic fluid from the low pressure reservoir 226 through inlet check valve 246 on the down-stroke of piston 242 (i.e., as cam 118 disengages piston 242). On the upstroke (i.e., when cam 118 engages piston 242), piston 242 pumps pressurized hydraulic fluid through outlet check valve 248 to the high pressure reservoir 236.

It will be understood that the invention is not limited to any particular pumping mechanism. As stated above, the invention is not limited to rotary steerable embodiments and thus is also not limited to a shaft actuated pumping mechanism. In other embodiments, an electromechanical pump may be utilized, for example, being powered via electrical power generated by a mud turbine.

It will also be understood that the force applying mechanism (the blade actuation mechanism) of the invention is not limited to hydraulic systems. In other embodiments of the invention, the blades may be actuated, for example, using electrical motors and gears. In such an embodiment, the blade pressure may be sensed, for example, by strain gauges deployed in the blades.

Hydraulic fluid chamber 220 further includes a pressurizing spring 234 (e.g., a Belleville spring) deployed between an internal shoulder 221 of the chamber housing and a high pressure piston 232. As the high pressure reservoir 236 is filled by pump 240, high pressure piston 232 compresses spring 234, which maintains the pressure in the high pressure reservoir 236 at some predetermined pressure above wellbore pressure. Hydraulic module 130 typically (although not necessarily) further includes a pressure relief valve 235 deployed between high pressure and low pressure fluid lines. In one exemplary embodiment, a spring loaded pressure relief valve 235 opens at a differential pressure of about 750 psi, thereby limiting the pressure of the high pressure reservoir 236 to a pressure of about 750 psi above wellbore pressure. However, the invention is not limited in this regard.

With continued reference to FIGS. 3A and 3B, extension and retraction of the blades 150A, 150B, and 150C are now described. The blades 150A, 150B, and 150C are essentially identical and thus the configuration and operation thereof are described only with respect to blade 150A. Blades 150B and 150C are referred to below in reference to exemplary hydraulic control methods in accordance with this invention. Blade 150A includes one or more blade pistons 252A deployed in corresponding chambers 244A, which are in fluid communication with both the low and high pressure reservoirs 226 and 236 through controllable valves 254A and 256A, respectively. In the exemplary embodiment shown, valves 254A and 256A include solenoid controllable valves, although the invention is not limited in this regard.

In order to extend blade 150A (radially outward from the tool body), valve 254A is opened and valve 256A is closed, allowing high pressure hydraulic fluid to enter chamber 244A. As chamber 244A is filled with pressurized hydraulic fluid, piston 252A is urged radially outward from the tool, which in turn urges blade 150A outward (e.g., into contact with the borehole wall). When blade 150A has been extended to a desired (predetermined) position, valve 254A may be closed, thereby "locking" the blade 150A in position (at the desired extension from the tool body).

In order to retract the blade (radially inward towards the tool body), valve 256A is open (while valve 254A remains closed). Opening valve 256A allows pressurized hydraulic fluid in chamber 244A to return to the low pressure reservoir 226. Blade 150A may be urged inward (towards the tool body), for example, via spring bias and/or contact with the borehole wall. In the exemplary embodiment shown, the blade 150A is not drawn inward under the influence of a hydraulic force, although the invention is not limited in this regard.

Hydraulic module 130 may also advantageously include one or more sensors, for example, for measuring the pressure and volume of the high pressure hydraulic fluid. In the exemplary embodiment shown on FIG. 3B, sensor 262 is disposed to measure hydraulic fluid pressure in reservoir 236. Likewise, sensors 272A, 272B, and 272C are disposed to measure hydraulic fluid pressure at blades 150A, 150B, and 150C, respectively. Position sensor 264 is disposed to measure the displacement of high pressure piston 232 and therefore the volume of high pressure hydraulic fluid in reservoir 236. Position sensors 274A, 274B, and 274C are disposed to measure the displacement of blade pistons 252A, 252B, and 252C and thus the extension of blades 150A, 150B, and 150C. In one exemplary embodiment of the invention, sensors 262, 272A, 272B, and 272C each include a pressure sensitive strain gauge, while sensors 264, 274A, 274B, and 274C each include a potentiometer having a resistive wiper, however, the invention is not limited in regard to the types of pressure and volume sensors utilized.

In the exemplary embodiments shown and described with respect to FIGS. 3A and 3B, hydraulic module 130 utilizes pressurized hydraulic oil in reservoirs 226 and 236. The artisan of ordinary skill will readily recognize that the invention is not limited in this regard and that pressurized drilling fluid, for example, may also be utilized to extend blades 150A, 150B, and 150C.

During a typical directional drilling application, a steering command may be received at steering tool 100, for example, via drill string rotation encoding. Exemplary drill string rotation encoding schemes are disclosed, for example, in commonly assigned U.S. Pat. Nos. 7,222,681 and 7,245,229. Upon receiving the steering command (which may be, for example, in the form of transmitted offset and tool face values), new blade positions are typically calculated and each of the blades 150A, 150B, and 150C is independently extended and/or retracted to its appropriate position (as measured by position sensors 274A, 274B, and 274C). Two of the blades (e.g., blades 150B and 150C) are preferably locked into position as described above (valves 254B, 254C, 256B, and 256C are closed). The third blade (e.g., blade 150A) preferably remains "floating" (i.e., open to high pressure hydraulic fluid via valve 256A) in order to maintain a grip on the borehole wall so that housing 110 does not rotate during drilling.

The predetermined blade positions are selected so as to achieve a desired tool face and offset of the steering tool housing in the borehole (so as to steer the drill bit in the desired direction). The offset is defined as the distance between the center locations of the borehole and the steering tool housing and the tool face is defined as the angular direction of the offset (tool face and offset in combination thus define an eccentricity vector for the tool in the borehole). The predetermined blade positions may then be calculated from the desired tool face and offset values and a borehole caliper measurement. The borehole caliper may be measured from blade displacement measurements (assuming each of the blades is in contact with the borehole wall). The center location of the borehole may then be computed from the blade displacement measurements, for example, by assuming a circular borehole. The predetermined blade positions are then calculated from the borehole caliper so as to achieve the desired tool face and offset (i.e., to appropriately offset the center of the tool housing from the center of the borehole). It is typically necessary to frequently recalculate the predetermined blade positions during drilling, for example, due to rotation of the housing in the borehole or changes in the borehole diameter. As such, frequent borehole caliper measurements are commonly required during drilling.

In prior art physical caliper measurement techniques (e.g., as described in the Webster patent), the borehole caliper can be computed based on the blade positions utilized during drilling (e.g., while floating one of the blades). While this approach has been utilized commercially, one drawback is that it tends to compromise the accuracy of the caliper measurement. For example, it has been found in certain drilling applications (e.g., in high dogleg or near horizontal borehole sections) that one or more of the locked blades (e.g., one or both of blades 150B and 150C) may fail to contact the borehole wall. The resultant caliper measurement is then not indicative of the actual borehole caliper. One way to overcome this difficulty is to extend each of the blades (i.e., float each of the blades) outward against the borehole wall (e.g., by opening each of valves 254A, 254B, and 254C while valves 256A, 256B, and 256C remain closed). While this technique typically results in an accurate caliper measurement (since each of the blades firmly contacts the borehole wall), it also typically tends to change the position of the steering tool in the borehole. For example, in low inclination wells the steering tool housing is typically moved towards the center of the borehole (thereby moving the steering tool housing away from the desired tool face and offset). In near horizontal wells the steering tool can sometimes be moved towards the low side of the borehole (depending on the weight of the BHA and other factors), which also tends to change the offset away from the desired value. This repositioning of the steering tool can be problematic in that it can temporarily change the direction of drilling (particularly in borehole sections having a high dogleg severity, i.e., requiring a large offset). Thus there is a need for improved caliper measurement and directional drilling techniques.

Figure 4:
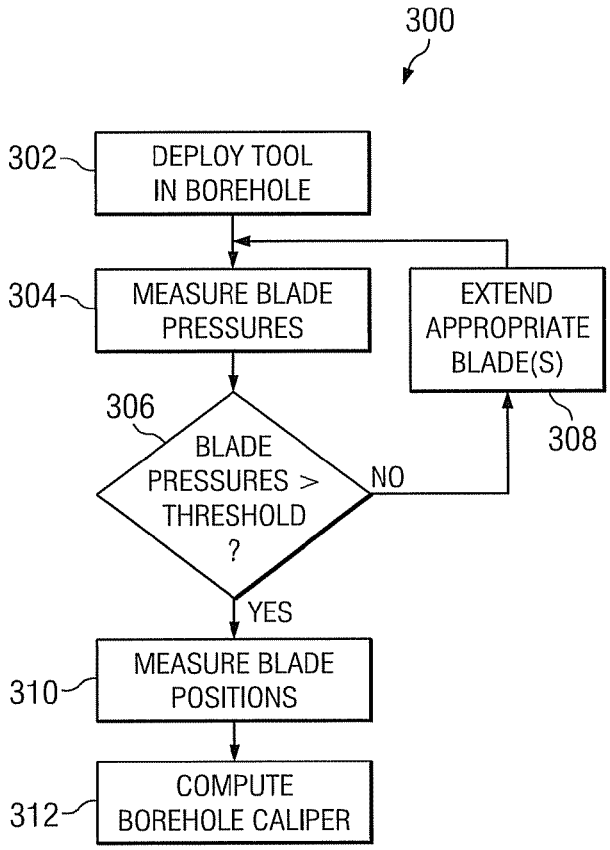
FIG. 4 depicts one exemplary method embodiment of the present invention in flowchart form.

With reference now to FIG. 4, a flow chart of a caliper measurement method 300 in accordance with the present invention is depicted. At 302 a downhole tool (such as tool 100) is deployed in a subterranean borehole and drilling commences (e.g., via rotating the drill string). At 304 the pressure is measured in each of the blades, e.g., using pressure sensors 272A, 272B, and 272C. At 306 the measured pressure in each of the blades (as measured in 304) is compared with a predetermined pressure threshold. If the measured pressure in any of the blades is less than the pressure threshold (indicating a low pressure contact between the blade and borehole wall) then the corresponding blade is extended at 308 (e.g., via opening valve 254) until the measured pressure in that blade is greater than the threshold (at which point valve 254 may be closed). When the measured pressure in each of the blades is greater than the threshold, the blade positions are measured at 310, e.g., using position sensors 274A, 274B, and 274C. The borehole caliper is then calculated at 312 using the blade position measurements made in 310.

Method 300 overcomes the above-described drawbacks of the prior art in that it provides for accurate borehole caliper measurements without repositioning the steering tool in the borehole. This is accomplished by measuring the pressure in each of the blades prior to measuring the position of the blades so as to ensure that each of the blades is in physical contact with the borehole wall. The caliper measurement is made only when the measured pressure in each of the blades is greater than a predetermined threshold. The invention is not limited to any particular threshold pressure value, however, in general the pressure threshold should be great enough so as to ensure firm contact between the blade and the borehole wall and not so great as to require floating all of the blades (and thereby repositioning the tool in the borehole). A pressure threshold of about 100 psi is preferred in rotary steerable embodiments.

The borehole caliper may be computed in 312 using equations known to those of ordinary skill in the art. For example, the center location of the borehole in Cartesian coordinates may be calculated using the following equations:

$$X_C = \frac{(Y_3 - Y_2)(Y_3 - Y_1)(Y_2 - Y_1) + (Y_2 - Y_1)(X_3^2 - X_1^2) - (Y_3 - Y_1)(X_2^2 - X_1^2)}{2[(X_3 - X_1)(Y_2 - Y_1) - (X_2 - X_1)(Y_3 - Y_1)]} \quad \text{Equation 1}$$

$$Y_C = \frac{(X_3 - X_2)(X_3 - X_1)(X_2 - X_1) + (X_2 - X_1)(Y_3^2 - Y_1^2) - (X_3 - X_1)(Y_2^2 - Y_1^2)}{2[(X_3 - X_1)(Y_2 - Y_1) - (X_2 - X_1)(Y_3 - Y_1)]}$$

where $X_C$ and $Y_C$ represent the center location of the borehole in the Cartesian coordinate reference frame of the downhole tool 100. The center location of the tool is defined to be (0,0) in this reference frame. The contact points of blades 1, 2, and 3 (e.g., blades 150A, 150B, and 150C) with the borehole wall are represented in Cartesian coordinates as $(X_1,Y_1)$, $(X_2,Y_2)$, and $(X_3,Y_3)$ respectively. These contact points may be calculated, for example, from the above described blade position (extension) measurements and a corresponding gravity tool face measurement. The radius and/or the diameter of the borehole may further be calculated, for example, as follows:

$$\text{Radius} = \frac{\text{Diameter}}{2} = \frac{\sqrt{(X_1 - X_C)^2 + (Y_1 - Y_C)^2}}{2} \quad \text{Equation 2}$$

Equations 1 and 2 have been selected to minimize downhole processing time and are therefore well suited for use with downhole microcontrollers having limited processing power. Equation 1, for example, includes only subtraction, multiplication, and division steps (and no trigonometric functions). The invention is of course not limited by these equations. The artisan of ordinary skill in the art will readily be able to derive similar mathematical expressions for computing borehole caliper using blade position measurements as an input. Nor is the invention limited in any way to the reference frame in which the borehole caliper is represented. Those of ordinary skill in the art will readily be able to compute the borehole caliper in substantially any suitable reference frame or convert the borehole caliper from one reference frame to another (e.g., from Cartesian coordinates to polar coordinates and/or from a tool reference frame to a borehole reference frame).

Equation 1 is selected for a tool embodiment having three blades that are equi-spaced about the circumference of the tool body (i.e., circumferentially spaced by about 120 degrees). The invention is, of course, not limited in regard to the spacing of the blades about the tool body. Nor is the invention limited to embodiments having three blades. A tool having substantially any number of blades (e.g., 4, 5, or even 6) may also be utilized. Those of ordinary skill in the art will readily be able to compute the borehole caliper for tools having asymmetric blade spacing and/or for tools having more than 3 blades.

While caliper measurement method 300 is described above with respect to a preferred embodiment in which the caliper measurement is made during drilling, it will be appreciated that the invention is not limited in this regard. Caliper measurements may also be made, for example, while tripping in and tripping out of the borehole, as well as during reaming, back reaming, and sliding operations. Nor is the invention limited to rotary steerable embodiments. Caliper measurements in accordance with the invention may also be made using a rotary steerable motor (a steerable motor having blades), an adjustable stabilizer, a vertical drilling device, a reaming device, and/or an LWD tool having extendable members.

Figure 5:
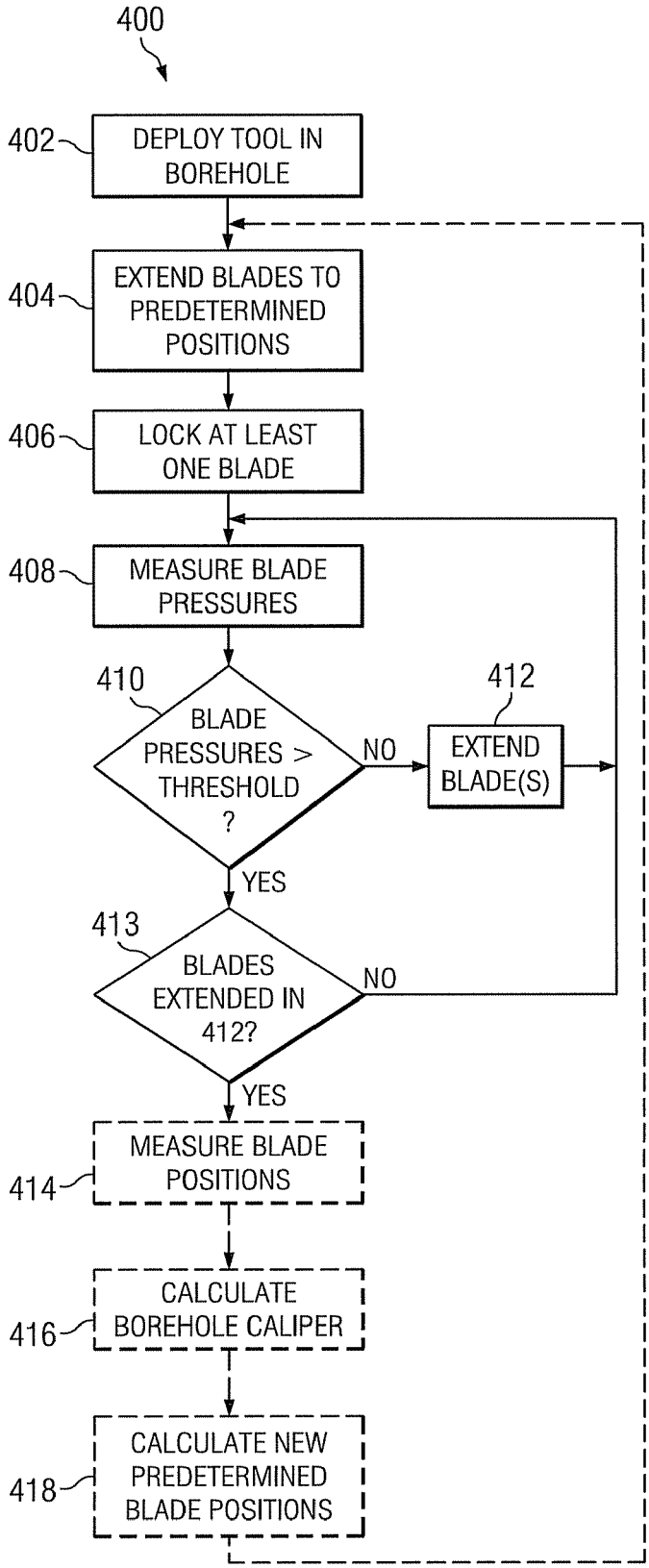
FIG. 5 depicts another exemplary method embodiment of the present invention in flowchart form.

With reference now to FIG. 5, a flow chart of a directional drilling method 400 in accordance with the present invention is depicted. In drilling method 400, at least a predetermined blade pressure is maintained at each of the blades at substantially all times during drilling. This tends to advantageously reduce housing roll (rotation of housing 110 in the borehole) and further tends to improve steering performance. At 402 a steering tool (such as tool 100) is deployed in a subterranean borehole and drilling commences (e.g., via rotating the drill string). At 404, each of the blades is extended (or retracted) to a corresponding predetermined radial position. At 406, at least one of the blades is locked at its corresponding radial position, e.g., via closing corresponding valves 254 and 256. Preferably first and second blades are locked (e.g., blades 150B and 150C). At 408 the hydraulic pressure is measure in each of the locked blades (e.g., in blades 150B and 150C using corresponding pressure sensors 272B and 272C).). At 410 the measured hydraulic pressure in each of the blades (as measured in 408) is compared with a predetermined pressure threshold. If the pressure in each of the blades is greater than the threshold, the controller typically waits a predetermined time (e.g., 1 second) before repeating steps 408 and 410 as indicated at 413. If the hydraulic pressure in any of the locked blades is less than the pressure threshold (indicating a low pressure contact between the blade and borehole wall) then the corresponding blade is extended at 412 (e.g., via opening valve 254) until the hydraulic pressure in that blade is greater than the threshold (at which time valve 254 is closed thereby again locking the blade in place). In this manner, the hydraulic pressure in each of the blades is maintained above the threshold during drilling.

Extension of one or more of the locked blades in 412 (in order to maintain the hydraulic pressure above the threshold) may sometimes change the direction of drilling (depending upon the degree of extension required). Therefore it may be advantageous in certain applications to recalculate the borehole caliper and the predetermined blade positions when any of the locked blades have been extended in 412. In such embodiments, the blade positions are measured at 414, e.g., via position sensors 274A, 274B, and 274C. The borehole caliper may then be calculated at 416, for example, as described above with respect to FIG. 4 and Equations 1 and 2. At 418, new predetermined blade positions may be calculated using the borehole caliper calculated in 416. After calculating the new predetermined blade positions in 418, the controller may return to steps 404 and 406 so as to extend (or retract) the blades to the new predetermined positions and lock at least one of the blades in the new position(s).

The new blade positions may be calculated at 416, for example, as follows:

$$C_i=\sqrt{a^2+b^2+2ab\cos\alpha_i} \qquad \text{Equation 3}$$

where $C_i$ represents the predetermined blade position of the corresponding $i^{th}$ blade (e.g., blade 150A, 150B, or 150C), a represents the target offset value, and b represents the borehole radius (e.g., as computed in Equation 2). The parameter $\alpha_i$ is in units of radians and is related to the target tool face angle (the direction of the target offset) and the measured tool face angle (e.g., the measured gravity tool face) of the $i^{th}$ blade and is represented mathematically as follows:

$$\alpha_i = \pi - \gamma_i - \arcsin\frac{a\sin\gamma_i}{b}$$

where $\gamma_i$ represents the difference between the target tool face angle and the measured tool face angle of the $i^{th}$ blade.

It will be appreciated that the invention is not limited by the above described equations. Those of ordinary skill in the art will readily be able to compute blade positions based on the borehole caliper and a target tool face and offset using known trigonometric relationships. Similar equations may also be expressed in different coordinate systems (e.g. Cartesian Coordinates).

It will be appreciated that the present invention may also be used in combination with other hydraulic system and/or blade pressure control mechanisms. For example, such control mechanisms may include those depicted on FIGS. 4 through 7 of co-pending, commonly invented, and commonly assigned, U.S. patent application Ser. No. 11/595,054 to Jones et al., the specification of which is fully incorporated herein by reference.

With reference again to FIG. 2, electronics module 140 includes a digital programmable processor such as a microprocessor or a microcontroller and processor-readable or computer-readable programming code embodying logic, including instructions for controlling the function of the steering tool 100. Substantially any suitable digital processor (or processors) may be utilized, for example, including an ADSP-2191M microprocessor, available from Analog Devices, Inc.

Electronics module 140 is disposed, for example, to execute control methods 300 and 400 described above with respect to FIGS. 4 and 5. In the exemplary embodiments shown, module 140 is in electronic communication with pressure sensors 262, 272A, 272B, 272C and position sensors 264, 274A, 274B, 274C. Electronic module 140 may further include instructions to receive rotation and/or flow rate encoded commands from the surface and to cause the steering tool 100 to execute such commands upon receipt. Module 140 typically further includes at least one tri-axial arrangement of accelerometers as well as instructions for computing gravity tool face and borehole inclination (as is known to those of ordinary skill in the art). Such computations may be made using either software or hardware mechanisms (using analog or digital circuits). Electronic module 140 may also further include one or more sensors for measuring the rotation rate of the drill string (such as accelerometer deployments and/or Hall-Effect sensors) as well as instructions executing rotation rate computations. Exemplary sensor deployments and measurement methods are disclosed, for example, in commonly assigned U.S. Pat. No. 7,426,967 and co-pending, commonly assigned U.S. patent application Ser. Nos. 11/454,019 (U.S. Publication 2007/0289373).

Electronic module 140 typically includes other electronic components, such as a timer and electronic memory (e.g., volatile or non-volatile memory). The timer may include, for example, an incrementing counter, a decrementing time-out counter, or a real-time clock. Module 140 may further include a data storage device, various other sensors, other controllable components, a power supply, and the like. Electronic module 140 is typically (although not necessarily) disposed to communicate with other instruments in the drill string, such as telemetry systems that communicate with the surface and an LWD tool including various other formation sensors. Electronic communication with one or more LWD tools may be advantageous, for example, in geo-steering applications. One of ordinary skill in the art will readily recognize that the multiple functions performed by the electronic module 140 may be distributed among a number of devices.

Although the present invention and its advantages have been described in detail, it should be understood that various changes, substitutions and alternations can be made herein without departing from the spirit and scope of the invention as defined by the appended claims.

We claim:

1. A downhole steering tool configured to operate in a borehole, the steering tool comprising:

at least three blades deployed on a housing, the blades disposed to extend radially outward from the housing and engage a wall of the borehole, said engagement of the blades with the borehole wall operative to eccenter the housing in the borehole;

a hydraulic module including a fluid chamber disposed to provide pressurized fluid to each of the plurality of blades, the pressurized fluid operative to extend the blades, each of the blades including a pressure sensor disposed to measure a fluid pressure in the blade and a position sensor disposed to measure a radial position of the blade; and a controller configured to (i) receive pressure measurements from the pressure sensors, (ii) receive radial position measurements from each of the blades only when each of the pressure measurements received in (i) is above a predetermined threshold pressure, and (iii) compute a borehole caliper from the position measurements received in (ii).

2. The downhole steering tool of claim 1, wherein the borehole caliper comprises a borehole diameter and a center location of the borehole.

3. The downhole steering tool of claim 1, wherein the controller is further configured to further extend at least one of the blades when the corresponding pressure measurement in said blade is less than the predetermined threshold pressure.

4. The downhole steering tool of claim 1, further comprising a shaft deployed in the housing, the housing and shaft disposed to rotate substantially freely with respect to one another about a longitudinal axis of the steering tool.

5. A downhole steering tool configured to operate in a borehole, the steering tool comprising:

At least three blades deployed on a housing, the blades disposed to extend radially outward from the housing and engage a wall of the borehole, said engagement of the blades with the borehole wall operative to eccenter the housing in the borehole;

a hydraulic module including a fluid chamber disposed to provide pressurized fluid to each of the plurality of blades, the pressurized fluid operative to extend the blades, each of the blades including at least a first valve in fluid communication with high pressure fluid and at least a second valve in fluid communication with low pressure fluid, each of the blades further including a pressure sensor disposed to measure a fluid pressure in the blade and a position sensor disposed to measure a radial position of the blade;

a controller configured to (i) lock at least one of the blades in a predetermined radially extended position by closing both the corresponding first and second valves, (ii) receive pressure measurements for each of the locked blades from the corresponding pressure sensors; (iii) radially further extend at least one of the locked blades by opening the corresponding first valve when the corresponding pressure measurement is less than a predetermined threshold, (iv) receive radial position measurements for each of the blades from the corresponding position sensors only when each of the pressure measurements received in (ii) is greater than the predetermined threshold pressure, and (v) compute a borehole caliper from the position measurements received in (iv).

6. The downhole steering tool of claim 5, wherein the controller is further configured to (vi) compute a new predetermined radial position for at least one of the blades using the borehole caliper computed in (v) and (vii) lock said blade in the new predetermined radially extended position by closing both the corresponding first and second valves.

7. The downhole steering tool of claim 5, further comprising a shaft deployed in the housing, the housing and shaft disposed to rotate substantially freely with respect to one another about a longitudinal axis of the steering tool.

8. A method for making a closed-loop physical caliper measurement in a subterranean borehole, the method comprising:

(a) deploying a drill string in a borehole, the drill string including a caliper measurement tool having at least three blades deployed thereon, each of the blades disposed on a tool body and configured to extend outward from the tool body into contact with a wall of the subterranean borehole;

(b) extending the blades outward from the tool body into contact with the wall of the subterranean borehole;

(c) measuring a blade pressure in each of the blades;

(d) measuring a radial position of each of the blades when the blade pressure measured in (c) in each of the blades is greater than a predetermined minimum threshold; and (e) computing a borehole caliper from the blade extension measurements made in (d).

9. The method of claim 8, wherein the blade pressure is a hydraulic pressure.

10. The method of claim 8, wherein (e) further comprises computing a borehole diameter and a central location of the borehole.

11. The method of claim 8, wherein (d) further comprises further extending at least one of the blades when the corresponding blade pressure measured in (c) is less than the predetermined threshold.

12. The method of claim 8, wherein the caliper measurement tool comprises a rotary steerable tool having at least three blades deployed on a housing, the blades disposed to extend radially outward from the housing and engage a wall of the borehole, said engagement of the blades with the borehole wall operative to eccenter the housing in the borehole.

13. A method of directional drilling, comprising:

(a) rotating a drill string in a borehole, the drill string including a rotary steerable tool having at least three blades deployed on a rotary steerable housing, the blades disposed to extend radially outward from the housing and engage a wall of the borehole, said engagement of the blades with the borehole wall operative to eccenter the housing in the borehole, each of the blades including at least a first valve in fluid communication with high pressure fluid and at least a second valve in fluid communication with low pressure fluid, each of the blades further including a corresponding pressure sensor disposed to measure a hydraulic fluid pressure in the blade and a position sensor disposed to measure a radial position of the blade;

(b) extending each of the blades to a corresponding first predetermined radial position;

(c) locking at least one of the blades at the corresponding predetermined radial position by closing the corresponding first and second valves;

(d) measuring a hydraulic pressure in each of said locked blades; and (e) further extending at least one of the locked blades to a position beyond the corresponding first predetermined radial position by opening the corresponding first valve(s) when the corresponding hydraulic pressure measured in (d) is less than a predetermined minimum threshold so that the hydraulic pressure in the blade is greater than the predetermined minimum threshold.

14. The method of claim 13, further comprising:

(f) measuring a new blade position for each of the blades after said extension of at least one of the locked blades in (e); and (g) calculating a borehole caliper from the new blade positions measured in (f).

15. The method of claim 14, further comprising:

(h) calculating second predetermined blade positions from the borehole caliper calculated in (g);

(i) repositioning the blades to the second predetermined blade positions calculated in (h); and (j) locking at least one of the blades at the corresponding second predetermined position by closing the corresponding first and second valves.

16. The method of claim 14, wherein the borehole caliper comprises a borehole diameter and a center location of the borehole.

17. The method of claim 13, wherein first and second blades are locked in (c).

* * * * *